US008292095B2

(12) United States Patent
Howlett

(10) Patent No.: US 8,292,095 B2
(45) Date of Patent: Oct. 23, 2012

(54) EXPANDABLE DISPLAY SYSTEM

(75) Inventor: Robert J. Howlett, Edison, NJ (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 338 days.

(21) Appl. No.: 12/769,131

(22) Filed: Apr. 28, 2010

(65) Prior Publication Data

US 2010/0276381 A1 Nov. 4, 2010

Related U.S. Application Data

(60) Provisional application No. 61/173,829, filed on Apr. 29, 2009.

(51) Int. Cl.
*A47G 29/00* (2006.01)
*A47F 3/14* (2006.01)
*A47J 47/00* (2006.01)

(52) U.S. Cl. ..... 211/73; 211/195; 211/126.16

(58) Field of Classification Search ..... 211/72, 211/73, 195, 126.16, 132.1, 126.6, 126.1; 206/45.21, 45.23, 45.25, 45.2, 45.24; 248/688, 248/459; 229/104
See application file for complete search history.

(56) References Cited

U.S. PATENT DOCUMENTS

| | | | | |
|---|---|---|---|---|
| 134,230 | A | | 12/1872 | Tripp |
| 289,174 | A | | 11/1883 | Taylor |
| 563,963 | A | | 7/1896 | Hobbs |
| 611,063 | A | | 9/1898 | Davis |
| 709,150 | A | | 9/1902 | Halls |
| 803,966 | A | | 11/1905 | Barnes |
| 890,135 | A | | 6/1908 | Gilliland |
| 1,015,926 | A | | 1/1912 | Anderson |
| 1,086,690 | A | | 2/1914 | Rosenberg |
| 1,093,873 | A | | 4/1914 | Mitchell |
| 1,179,973 | A | | 4/1916 | Streit |
| 1,188,452 | A | | 6/1916 | Johnson |
| 1,272,349 | A | | 7/1918 | Abrahams |
| 1,367,048 | A | | 2/1921 | Horr |
| 1,383,375 | A | | 7/1921 | Bilger |
| 1,407,526 | A | | 2/1922 | Glover |
| 1,410,869 | A | * | 3/1922 | Allan ..... 206/45.21 |
| 1,416,465 | A | * | 5/1922 | Harvey ..... 206/45.21 |
| 1,431,133 | A | | 10/1922 | Young |

(Continued)

FOREIGN PATENT DOCUMENTS

DE 2116726 10/1972

(Continued)

OTHER PUBLICATIONS

"Alliance, A Rock-Tenn Company Concept to Consumer™", Oral-B Brochure, 2 Research Drive, Bethel, CT 06801 undated , 1 page.

(Continued)

*Primary Examiner* — Jennifer E. Novosad
(74) *Attorney, Agent, or Firm* — Kilpatrick Townsend & Stockton LLP

(57) ABSTRACT

Described herein are embodiments of an expandable display system that have an expanded position for retail display and a collapsed position for efficient shipping. The expandable display system includes a product tray and an associated easel support, with the easel support being configured to expand and lock into the expanded position to support the product tray at an inclined angle relative to a surface on which the easel support rests. In some embodiments, the product tray and the associated easel support are integral.

20 Claims, 13 Drawing Sheets

U.S. PATENT DOCUMENTS

| | | | | | |
|---|---|---|---|---|---|
| 1,448,767 | A | | 3/1923 | Robbins | |
| 1,460,132 | A | | 6/1923 | Horr | |
| 1,486,695 | A | | 3/1924 | Singer et al. | |
| 1,497,536 | A | * | 6/1924 | Billstein | 206/45.21 |
| 1,536,949 | A | * | 5/1925 | Tinsley | 206/45.21 |
| 1,588,848 | A | | 6/1926 | McKinstry | |
| 1,590,683 | A | | 6/1926 | Helfrich | |
| 1,612,398 | A | | 12/1926 | Scherotto | |
| 1,668,171 | A | | 5/1928 | Pratt | |
| 1,674,953 | A | | 6/1928 | Darragh | |
| 1,676,356 | A | | 7/1928 | Sapinsley | |
| 1,682,463 | A | | 8/1928 | Anderson | |
| 1,685,125 | A | | 9/1928 | Einson | |
| 1,733,114 | A | | 10/1929 | Brennan | |
| 1,737,740 | A | | 12/1929 | Stockman | |
| 1,770,618 | A | | 7/1930 | Lambert | |
| 1,775,338 | A | * | 9/1930 | Darragh | 206/45.21 |
| 1,803,861 | A | | 5/1931 | Marvin | |
| 1,808,833 | A | | 6/1931 | Brack | |
| 1,859,903 | A | | 5/1932 | Wellman | |
| 1,881,707 | A | | 10/1932 | Larkin | |
| 1,911,678 | A | | 5/1933 | Dunn, Jr. | |
| 1,916,045 | A | | 6/1933 | Freymann | |
| 1,925,102 | A | | 9/1933 | Levkoff | |
| 1,932,429 | A | | 10/1933 | Wellman | |
| 1,955,252 | A | | 4/1934 | Palla | |
| 1,965,794 | A | | 7/1934 | Davidson | |
| 1,972,406 | A | | 9/1934 | Marsh | |
| 1,974,926 | A | | 9/1934 | Marsh | |
| 2,006,445 | A | * | 7/1935 | Davidson | 206/45.21 |
| 2,031,575 | A | | 2/1936 | Roe | |
| 2,036,864 | A | | 4/1936 | Einson | |
| 2,052,675 | A | | 9/1936 | Tanner | |
| 2,074,229 | A | | 3/1937 | McKee | |
| 2,091,355 | A | | 8/1937 | Ekedahl et al. | |
| 2,104,523 | A | | 1/1938 | Lichtenstein | |
| 2,108,516 | A | | 2/1938 | Thompson | |
| 2,112,135 | A | * | 3/1938 | Bonville | 206/45.23 |
| 2,167,947 | A | * | 8/1939 | Hayes | 206/45.21 |
| 2,182,932 | A | | 12/1939 | Sanford | |
| 2,209,657 | A | | 7/1940 | Martin | |
| 2,213,115 | A | | 8/1940 | Bales | |
| 2,222,091 | A | | 11/1940 | Schray | |
| 2,231,091 | A | | 2/1941 | Saulsbury | |
| 2,259,041 | A | | 10/1941 | Larkin | |
| 2,269,715 | A | | 1/1942 | Fischer | |
| 2,283,950 | A | | 5/1942 | Ringler | |
| 2,317,203 | A | * | 4/1943 | Kurhan | 206/45.23 |
| 2,319,919 | A | | 5/1943 | Clark | |
| 2,322,849 | A | | 6/1943 | Horr | |
| 2,326,926 | A | | 8/1943 | Bureau et al. | |
| 2,327,878 | A | | 8/1943 | Ezrol | |
| 2,339,383 | A | | 1/1944 | Davidson | |
| 2,343,222 | A | | 2/1944 | Nelson | |
| 2,350,163 | A | | 5/1944 | Reynolds | |
| 2,357,555 | A | | 9/1944 | Seaton | |
| 2,369,728 | A | | 2/1945 | Farkas | |
| 2,426,911 | A | | 9/1947 | Williamson | |
| 2,443,871 | A | | 6/1948 | Shield | |
| 2,456,817 | A | | 12/1948 | Davenport | |
| 2,495,676 | A | | 1/1950 | Wells | |
| 2,540,595 | A | | 2/1951 | Props | |
| 2,550,968 | A | | 5/1951 | Bussey | |
| 2,562,497 | A | | 7/1951 | Klein | |
| 2,585,361 | A | * | 2/1952 | Williamson | 206/45.22 |
| 2,601,374 | A | | 6/1952 | Ditzler et al. | |
| 2,604,982 | A | | 7/1952 | Cibie | |
| 2,624,455 | A | | 1/1953 | Myers | |
| 2,675,913 | A | | 4/1954 | Brachman | |
| 2,680,522 | A | | 6/1954 | Temple | |
| 2,683,953 | A | | 7/1954 | Hopkins | |
| 2,706,037 | A | | 4/1955 | Feigelman | |
| 2,706,593 | A | | 4/1955 | Caraher | |
| 2,710,241 | A | | 6/1955 | Lieberman | |
| 2,735,638 | A | | 2/1956 | Hanson | |
| 2,762,550 | A | | 9/1956 | Goettsch et al. | |
| 2,765,906 | A | | 10/1956 | Rossum | |
| 2,787,371 | A | * | 4/1957 | Curtis | 206/45.21 |
| 2,791,367 | A | | 5/1957 | Mefford | |
| 2,793,760 | A | | 5/1957 | Zel | |
| 2,794,555 | A | | 6/1957 | Schild | |
| 2,796,037 | A | | 6/1957 | Feigelman | |
| 2,796,158 | A | | 6/1957 | Miles et al. | |
| 2,797,815 | A | | 7/1957 | Gorman | |
| 2,804,199 | A | | 8/1957 | Essick | |
| 2,808,190 | A | | 10/1957 | Buhrmaster et al. | |
| 2,810,474 | A | | 10/1957 | Essick | |
| 2,812,852 | A | | 11/1957 | Samuels | |
| 2,836,338 | A | | 5/1958 | Daniels | |
| 2,839,350 | A | | 6/1958 | Hill et al. | |
| 2,902,239 | A | | 9/1959 | Janecka, Jr. | |
| 2,915,193 | A | | 12/1959 | Bromberg | |
| 2,936,904 | A | | 5/1960 | Streater | |
| 2,941,670 | A | | 6/1960 | Fagan et al. | |
| 2,953,244 | A | | 9/1960 | Phillips | |
| 2,964,169 | A | | 12/1960 | Brachman | |
| 2,980,242 | A | | 4/1961 | Miller | |
| 3,001,685 | A | | 9/1961 | Blount | |
| 3,002,608 | A | | 10/1961 | Zwickey | |
| 3,007,622 | A | | 11/1961 | George | |
| 3,019,959 | A | | 2/1962 | Skowronski | |
| 3,029,008 | A | | 4/1962 | Membrino | |
| 3,043,490 | A | | 7/1962 | Burnett | |
| 3,052,363 | A | | 9/1962 | Foote, Jr. et al. | |
| 3,055,293 | A | | 9/1962 | Lariccia | |
| 3,055,507 | A | | 9/1962 | Kobs | |
| 3,055,573 | A | | 9/1962 | Carter | |
| 3,062,430 | A | | 11/1962 | Rutledge | |
| 3,069,062 | A | | 12/1962 | Keith | |
| 3,085,694 | A | | 4/1963 | Jones | |
| 3,090,492 | A | | 5/1963 | Goldstein | |
| 3,094,892 | A | | 6/1963 | Topf | |
| 3,100,460 | A | | 8/1963 | McElroy | |
| 3,111,255 | A | | 11/1963 | Skowronski | |
| 3,115,106 | A | | 12/1963 | Gersch | |
| 3,118,587 | A | | 1/1964 | Welshenbach | |
| 3,120,200 | A | | 2/1964 | Travis | |
| 3,126,101 | A | | 3/1964 | Katterjohn | |
| 3,157,345 | A | | 11/1964 | George | |
| 3,167,179 | A | | 1/1965 | Goldstein | |
| 3,167,180 | A | | 1/1965 | Kremp | |
| 3,167,719 | A | | 1/1965 | Goldstein | |
| 3,168,192 | A | | 2/1965 | Nicholson et al. | |
| 3,171,541 | A | | 3/1965 | Weisberger | |
| 3,184,075 | A | | 5/1965 | Cohen | |
| 3,185,294 | A | | 5/1965 | Lustman | |
| 3,186,542 | A | | 6/1965 | Greene | |
| 3,193,108 | A | | 7/1965 | Johnson | |
| 3,198,342 | A | | 8/1965 | Murray | |
| 3,204,851 | A | | 9/1965 | Rouder et al. | |
| 3,209,919 | A | | 10/1965 | Hoogstoel | |
| 3,227,266 | A | | 1/1966 | Soma | |
| 3,229,944 | A | | 1/1966 | Everburg | |
| 3,231,077 | A | | 1/1966 | Grimm | |
| 3,235,166 | A | | 2/1966 | Guyer | |
| 3,241,738 | A | | 3/1966 | Freiman | |
| 3,245,527 | A | | 4/1966 | Martin | |
| 3,252,678 | A | | 5/1966 | Meyers et al. | |
| 3,254,758 | A | | 6/1966 | Guyer | |
| 3,254,825 | A | | 6/1966 | Nolen | |
| 3,262,559 | A | | 7/1966 | Geiger | |
| 3,265,284 | A | | 8/1966 | Tomkins | |
| 3,273,844 | A | | 9/1966 | Hodson et al. | |
| 3,276,400 | A | | 10/1966 | Brunette | |
| 3,276,667 | A | | 10/1966 | Johnson et al. | |
| 3,285,492 | A | | 11/1966 | Demby et al. | |
| 3,297,374 | A | | 1/1967 | Radek | |
| 3,302,844 | A | | 2/1967 | Warren | |
| 3,310,221 | A | | 3/1967 | Duncan | |
| 3,310,223 | A | | 3/1967 | Buttery | |
| 3,311,436 | A | | 3/1967 | Vitale | |
| 3,312,442 | A | | 4/1967 | Moeller | |
| 3,314,587 | A | | 4/1967 | Johnson | |
| 3,326,361 | A | | 6/1967 | Zimmerman | |
| 3,341,026 | A | | 9/1967 | Spitler | |
| 3,367,291 | A | | 2/1968 | Evans | |
| 3,371,844 | A | | 3/1968 | Perrella | |

3,392,905 A 7/1968 Caldwell
3,428,234 A 2/1969 Barry
3,433,365 A 3/1969 Hodson
3,469,710 A 9/1969 Yosbikian
3,476,023 A 11/1969 Fuller
3,481,485 A 12/1969 Hess
3,483,995 A 12/1969 Larson
3,492,772 A 2/1970 Bergman
3,510,046 A 5/1970 Reiner
3,516,634 A 6/1970 Salaua et al.
3,523,636 A 8/1970 Phillips
3,531,045 A 9/1970 Johnson
3,543,998 A 12/1970 Dunlap
3,561,669 A 2/1971 Postweiler
3,567,014 A 3/1971 Feigelman
3,568,911 A 3/1971 Bebout
3,606,969 A 9/1971 Voytko
3,608,705 A 9/1971 Moshel
3,640,190 A 2/1972 Fuller
3,643,856 A 2/1972 Jones
3,664,494 A 5/1972 Mergens
3,669,251 A 6/1972 Phillips
3,691,671 A 9/1972 Kroll
3,692,230 A 9/1972 Kapiloff
3,695,508 A 10/1972 Hocking
3,713,577 A 1/1973 Skinner
3,721,381 A 3/1973 Locke
3,721,413 A 3/1973 Robinson
3,730,417 A 5/1973 Lawson
3,744,702 A 7/1973 Ellison
3,750,870 A 8/1973 Cote
3,777,897 A 12/1973 Gray
3,799,357 A 3/1974 Govang
3,815,808 A 6/1974 Bunnell
3,828,923 A 8/1974 Phillips, Jr.
3,835,989 A 9/1974 Mori et al.
3,844,231 A 10/1974 Peacock
3,850,396 A 11/1974 Orlandi
3,884,348 A 5/1975 Ross
3,884,349 A 5/1975 Charles
3,893,614 A 7/1975 Meyers
3,910,482 A 10/1975 Bamburg et al.
3,910,483 A 10/1975 Ritter
3,912,158 A 10/1975 Taub
3,917,158 A 11/1975 Dorofachuk et al.
3,918,576 A 11/1975 Taub
3,926,362 A 12/1975 Beck et al.
3,935,798 A 2/1976 Paxton
3,942,631 A 3/1976 Sutherland et al.
3,955,671 A 5/1976 Ockey
3,955,743 A 5/1976 Tanneberger
3,960,312 A 6/1976 Gorham
3,967,774 A 7/1976 Querner
3,999,775 A 12/1976 Brongo
4,000,811 A 1/1977 Hardison et al.
4,020,946 A 5/1977 Gardner et al.
4,025,137 A 5/1977 Wyler
4,032,014 A 6/1977 Weiss
4,037,729 A 7/1977 DeSisto
4,049,114 A 9/1977 Danheisser
4,058,206 A 11/1977 Morse et al.
4,093,078 A 6/1978 Radek
4,103,819 A 8/1978 Muise
4,113,100 A 9/1978 Soja et al.
4,133,474 A 1/1979 Hall
RE29,977 E 5/1979 Lundqvist
4,174,803 A 11/1979 Shrontz et al.
4,184,602 A 1/1980 Moliard
4,184,625 A 1/1980 Stollberg et al.
4,191,288 A 3/1980 Hostad
4,196,539 A 4/1980 Speers
4,196,843 A 4/1980 Garmon
4,197,939 A 4/1980 Dogliotti
4,211,322 A 7/1980 Crescenzi et al.
4,217,984 A 8/1980 Magnuson
4,235,032 A 11/1980 Robinson
4,274,577 A 6/1981 Walsh
4,284,204 A 8/1981 Carey, Jr.
4,299,327 A 11/1981 Thauer
4,303,163 A 12/1981 Henry
4,313,544 A 2/1982 Ashton
4,326,665 A 4/1982 Scott
4,331,231 A * 5/1982 Boyle ..... 206/45.25
4,350,281 A 9/1982 Dornbusch et al.
D267,608 S 1/1983 Brescia et al.
4,371,085 A 2/1983 Fredrickson
4,392,605 A 7/1983 Backman
4,396,144 A 8/1983 Gutierrez et al.
4,408,689 A 10/1983 Daniels
4,428,389 A 1/1984 Sanchez Cordero
4,429,826 A 2/1984 Shedd
4,433,778 A * 2/1984 Maio et al. ..... 206/45.25
4,441,619 A 4/1984 Gibitz
4,444,322 A 4/1984 Lee
4,444,354 A 4/1984 Staelgraeve
4,456,147 A 6/1984 Tominaga
4,473,963 A 10/1984 Hardy et al.
4,474,297 A 10/1984 Zucker
4,483,095 A 11/1984 Webinger
4,485,929 A 12/1984 Betts
4,494,661 A 1/1985 Krusche
4,541,586 A 9/1985 Crowe
4,553,666 A 11/1985 Gullikson
4,558,785 A 12/1985 Gordon
4,565,316 A 1/1986 Jes
4,567,981 A 2/1986 Headon
4,570,805 A 2/1986 Smith
4,598,828 A 7/1986 Young et al.
4,611,866 A 9/1986 Everett
4,641,746 A 2/1987 Dornbusch et al.
4,642,605 A 2/1987 Karp
4,646,922 A 3/1987 Smith
4,646,960 A 3/1987 Challand
4,655,352 A 4/1987 Noyes et al.
4,663,872 A 5/1987 Finger
4,671,417 A 6/1987 O'Brien
4,697,712 A 10/1987 Valiulis
4,711,046 A 12/1987 Herrgord
4,724,855 A 2/1988 Jackson et al.
4,732,283 A 3/1988 Schmidt
4,744,489 A 5/1988 Binder et al.
4,750,612 A * 6/1988 Schuster ..... 206/45.29
4,756,409 A 7/1988 Murray
4,760,928 A 8/1988 Bustos
4,767,022 A 8/1988 Oldorf
4,771,898 A 9/1988 Howard et al.
4,773,622 A 9/1988 Herlin
4,779,745 A 10/1988 Prendergast et al.
4,784,271 A 11/1988 Wosaba, II et al.
4,787,515 A 11/1988 Stoll
4,791,898 A 12/1988 Jayne
4,796,783 A 1/1989 Paulson
4,809,847 A 3/1989 Schneider
4,827,951 A 5/1989 Grussmark
4,848,651 A 7/1989 Hartness
4,860,905 A 8/1989 Schott et al.
4,869,424 A 9/1989 Wood
4,871,067 A 10/1989 Valenti
4,886,160 A 12/1989 Kligerman
4,893,711 A 1/1990 Gustafson
4,911,309 A 3/1990 Stefan
4,925,038 A 5/1990 Gajewski
4,938,413 A 7/1990 Wolfe
4,947,984 A 8/1990 Kaufman et al.
4,978,013 A 12/1990 Hogg
4,991,804 A 2/1991 Iannucci
4,993,561 A 2/1991 Stultz
D315,451 S 3/1991 Lapin
4,997,106 A 3/1991 Rockola
5,007,530 A * 4/1991 Weismantel ..... 206/45.21
5,007,580 A 4/1991 Morrison et al.
5,016,753 A 5/1991 Henderson
5,040,688 A 8/1991 Martin
5,048,690 A 9/1991 Zimmerman
D321,615 S 11/1991 Lavine et al.
5,076,302 A 12/1991 Chari
5,076,491 A 12/1991 Freudentahl et al.
5,083,668 A 1/1992 Bushey 5,088,599 A 2/1992 Mahler
5,096,074 A 3/1992 Merl
5,101,988 A 4/1992 Meyer
D326,970 S 6/1992 Allen
5,137,211 A 8/1992 Summer et al.
5,154,309 A 10/1992 Wischusen et al.
5,167,324 A 12/1992 Miller
5,170,897 A 12/1992 Wentworth
5,170,934 A 12/1992 Lemoine
5,180,052 A 1/1993 Smith et al.
5,181,650 A 1/1993 Hollander
5,192,019 A 3/1993 Meehan
5,195,677 A 3/1993 Quintana et al.
5,201,191 A 4/1993 Bustos
5,201,868 A 4/1993 Johnson
5,203,126 A 4/1993 Sorenson et al.
5,215,199 A 6/1993 Bejarano
5,251,753 A 10/1993 Pigott et al.
5,272,991 A 12/1993 Carrigan, Jr.
5,273,169 A 12/1993 Maglione
5,288,012 A 2/1994 DeMay
5,289,943 A 3/1994 Powell
5,295,596 A 3/1994 Squitieri
5,322,024 A 6/1994 Avery et al.
5,330,050 A 7/1994 Stansbury, Jr. et al.
5,348,147 A 9/1994 Gottfreid
5,351,882 A 10/1994 Krautsack
5,370,220 A 12/1994 Wang
5,370,233 A 12/1994 Schutz et al.
5,375,702 A * 12/1994 Fiallo ..... 206/45.21
5,377,821 A 1/1995 Fierek
5,392,902 A 2/1995 Vlastakis
5,398,868 A 3/1995 Densen
5,413,276 A 5/1995 Sheffer
5,417,342 A 5/1995 Hutchison
D363,623 S 10/1995 Rushing
5,454,180 A 10/1995 Volpe
5,464,103 A 11/1995 O'Brien
5,465,831 A 11/1995 Smith
5,477,636 A 12/1995 Musket
5,489,023 A 2/1996 Havlovitz
5,502,277 A 3/1996 Sakata
D369,036 S 4/1996 Wyatt et al.
5,505,314 A 4/1996 O'Brien
5,505,368 A 4/1996 Kanter et al.
5,505,369 A 4/1996 Taliaferro
5,505,371 A 4/1996 O'Neill
5,507,430 A 4/1996 Imhoff
5,522,574 A 6/1996 Maglione
5,542,552 A 8/1996 Yablans et al.
5,547,073 A 8/1996 Smith
D373,913 S 9/1996 Wyatt et al.
5,555,991 A 9/1996 Hart
5,560,692 A 10/1996 Smith
5,582,343 A 12/1996 Dalvey
5,582,345 A 12/1996 Lankhuijzen
5,590,788 A 1/1997 Inman
5,595,309 A 1/1997 Bauer et al.
5,609,253 A 3/1997 Goade, Sr.
5,620,104 A 4/1997 Maglione
5,624,044 A 4/1997 Black, Jr.
5,630,518 A 5/1997 Collins
5,645,176 A 7/1997 Jay
5,647,566 A 7/1997 Kump
5,657,872 A 8/1997 Leftwich et al.
5,690,213 A 11/1997 Matsumura
5,697,505 A 12/1997 Sprague
5,704,497 A 1/1998 Wyatt
5,715,993 A 2/1998 Pareike
5,726,207 A 3/1998 MacLean et al.
5,730,296 A 3/1998 Limmer
5,732,722 A 3/1998 Mortvedt
5,732,834 A 3/1998 Wells
5,732,928 A * 3/1998 Chang ..... 248/688
5,762,203 A 6/1998 Klawiter et al.
5,762,207 A 6/1998 Maglione
5,785,187 A 7/1998 Lipman et al.
5,803,276 A 9/1998 Vogler
5,809,673 A 9/1998 Johnson et al.
5,819,996 A 10/1998 Koons, Jr.
5,836,459 A 11/1998 Nezwek et al.
5,842,576 A 12/1998 Snow
5,868,367 A 2/1999 Smith
5,881,884 A 3/1999 Podosek
5,884,784 A 3/1999 Betts, Sr.
5,896,995 A 4/1999 Murray et al.
5,927,517 A 7/1999 Lipman et al.
5,947,307 A 9/1999 Battaglia et al.
5,948,498 A 9/1999 Bianco et al.
5,950,914 A 9/1999 Dunton
5,975,413 A 11/1999 Moen
5,979,706 A 11/1999 Grussmark
6,012,582 A 1/2000 Haygeman et al.
6,012,688 A 1/2000 LaMotte
6,038,797 A 3/2000 Smith
D422,164 S 4/2000 Ray et al.
6,053,325 A 4/2000 Yonker
6,073,833 A 6/2000 Desrosiers et al.
6,092,716 A 7/2000 Smith
6,129,211 A 10/2000 Prakken et al.
6,164,526 A 12/2000 Dalvey
D435,743 S 1/2001 Glauth et al.
6,170,674 B1 1/2001 Caterinacci
6,173,516 B1 1/2001 Duerrstein
6,206,212 B1 3/2001 Loew
6,216,944 B1 4/2001 Maglione
6,227,370 B1 5/2001 Earnshaw et al.
6,234,436 B1 5/2001 Kump
6,257,442 B1 7/2001 Fredmark
6,279,818 B1 8/2001 Kim
6,286,753 B1 9/2001 Jackson et al.
6,293,405 B1 9/2001 Burch, Jr.
6,302,323 B1 10/2001 Southwell
6,352,151 B1 * 3/2002 Stewart ..... 206/45.29
6,357,654 B1 3/2002 Gardner et al.
6,364,137 B1 4/2002 Glauth et al.
6,371,365 B1 4/2002 Doucette et al.
6,386,369 B2 5/2002 Yuhas et al.
6,386,371 B1 5/2002 Parsons
6,393,748 B1 5/2002 Cooper
6,394,273 B1 5/2002 Dixon
6,394,290 B1 5/2002 Walsh et al.
6,402,021 B1 6/2002 Heathcock
6,405,921 B1 6/2002 Cochrane
6,409,077 B1 6/2002 Telesca et al.
6,431,364 B1 8/2002 Saladyga
6,435,351 B1 8/2002 Gibb
6,450,328 B1 * 9/2002 Machacek et al. ..... 206/63.5
6,457,637 B1 10/2002 Fritz et al.
6,467,856 B1 10/2002 Chang et al.
6,478,159 B1 11/2002 Taylor et al.
6,488,200 B1 12/2002 Jensen, Jr.
6,510,982 B2 1/2003 White et al.
6,523,288 B1 2/2003 Sackett
6,523,692 B2 2/2003 Gregory
6,557,708 B2 5/2003 Polacco
6,557,711 B2 5/2003 Grueneberg
6,591,995 B1 7/2003 Grove
6,623,060 B2 9/2003 Gehring et al.
6,647,650 B1 11/2003 Jones et al.
6,663,332 B1 12/2003 Sluijk
6,695,144 B2 2/2004 Freeze
6,712,214 B1 3/2004 Wintermute
6,718,669 B1 4/2004 Hayes
6,729,475 B2 5/2004 Yuhas et al.
6,755,306 B2 6/2004 Maus
6,758,340 B1 7/2004 Feibelman
6,758,349 B1 7/2004 Kwap et al.
6,758,354 B2 7/2004 Carletti
6,789,688 B2 9/2004 Rousch
6,793,070 B2 9/2004 Dye
6,832,683 B2 12/2004 Boriani et al.
D503,614 S 4/2005 Sax et al.
6,886,737 B2 5/2005 Dye
6,889,856 B2 5/2005 Clark
6,929,133 B1 8/2005 Knapp, III et al.
6,932,265 B2 8/2005 Sax et al.
6,935,509 B2 8/2005 Egresitz

| | | | | |
|---|---|---|---|---|
| 6,948,617 | B2 | 9/2005 | Kanter et al. | |
| 6,974,033 | B2 | 12/2005 | McLeod et al. | |
| 6,976,588 | B2 | 12/2005 | Wischusen et al. | |
| 6,986,456 | B2 | 1/2006 | Jone | |
| 6,991,116 | B2 | 1/2006 | Johnson et al. | |
| 7,036,256 | B2 | 5/2006 | Carlin et al. | |
| 7,066,321 | B2 | 6/2006 | Kawaguchi et al. | |
| 7,066,333 | B2 | 6/2006 | Justice | |
| 7,066,379 | B2 | 6/2006 | McLeod et al. | |
| 7,070,089 | B2 | 7/2006 | Kim | |
| 7,080,736 | B2 | 7/2006 | Jackson et al. | |
| 7,083,053 | B2 | 8/2006 | Campbell | |
| 7,104,435 | B2 | 9/2006 | Holley | |
| 7,104,715 | B2 | 9/2006 | Lahr | |
| 7,134,230 | B1 | 11/2006 | Boens et al. | |
| 7,147,113 | B2 | 12/2006 | Obstfeld et al. | |
| 7,175,066 | B2 | 2/2007 | Varanasi | |
| 7,185,861 | B2 | 3/2007 | LaMotte | |
| 7,185,869 | B2 | 3/2007 | Smith | |
| 7,237,674 | B2 | 7/2007 | Auclair | |
| 7,258,265 | B2 | 8/2007 | Loew | |
| 7,331,508 | B2 | 2/2008 | Kanter et al. | |
| 7,367,539 | B2 | 5/2008 | Moss et al. | |
| 7,373,765 | B2 | 5/2008 | Welchel et al. | |
| 7,377,385 | B2 | 5/2008 | Giannini et al. | |
| 7,389,875 | B2 | 6/2008 | Sandberg et al. | |
| 7,401,711 | B2 | 7/2008 | Spivey | |
| 7,431,163 | B2 | 10/2008 | Andersen | |
| 7,478,725 | B2 | 1/2009 | Holley | |
| 7,523,842 | B2 | 4/2009 | Spivey | |
| 7,841,575 | B1 * | 11/2010 | Sliger | 248/454 |
| 2002/0130098 | A1 | 9/2002 | Simard | |
| 2002/0139808 | A1 | 10/2002 | Grueneberg | |
| 2002/0175106 | A1 | 11/2002 | Nemoto | |
| 2003/0106835 | A1 | 6/2003 | Hubbs et al. | |
| 2003/0136821 | A1 | 7/2003 | Prokosch et al. | |
| 2004/0060884 | A1 | 4/2004 | Nook et al. | |
| 2004/0104138 | A1 | 6/2004 | Remaks | |
| 2004/0148833 | A1 | 8/2004 | Virvo | |
| 2004/0256341 | A1 | 12/2004 | Donnell et al. | |
| 2005/0000853 | A1 | 1/2005 | Rochefort et al. | |
| 2005/0023168 | A1 | 2/2005 | Marnocha | |
| 2005/0067362 | A1 | 3/2005 | Martin et al. | |
| 2005/0067473 | A1 | 3/2005 | Muise, Jr. | |
| 2005/0072746 | A1 | 4/2005 | O'Brien | |
| 2005/0092705 | A1 | 5/2005 | Moss et al. | |
| 2005/0103681 | A1 * | 5/2005 | Aubry et al. | 206/767 |
| 2005/0109670 | A1 | 5/2005 | Loew | |
| 2005/0161496 | A1 | 7/2005 | McLeod et al. | |
| 2005/0184139 | A1 | 8/2005 | Gasior | |
| 2005/0189311 | A1 | 9/2005 | Colby et al. | |
| 2005/0263434 | A1 | 12/2005 | Tibbels | |
| 2005/0270730 | A1 | 12/2005 | Klushin et al. | |
| 2005/0279906 | A1 | 12/2005 | Moss et al. | |
| 2006/0006096 | A1 | 1/2006 | Funk | |
| 2006/0118460 | A1 | 6/2006 | McKenzie | |
| 2006/0157433 | A1 * | 7/2006 | Pedler et al. | 211/72 |
| 2006/0278782 | A1 | 12/2006 | Lockwood et al. | |
| 2006/0283927 | A1 | 12/2006 | Walsh et al. | |
| 2007/0221715 | A1 | 9/2007 | Tibbels et al. | |
| 2007/0227921 | A1 | 10/2007 | Hluchan | |
| 2007/0246398 | A1 | 10/2007 | Pedler | |
| 2007/0278282 | A1 | 12/2007 | Jolley et al. | |
| 2008/0034632 | A1 | 2/2008 | Urban et al. | |
| 2008/0078691 | A1 | 4/2008 | Malik et al. | |
| 2008/0087556 | A1 * | 4/2008 | Henke et al. | 206/45.23 |
| 2008/0105594 | A1 | 5/2008 | Luberto | |
| 2008/0203038 | A1 * | 8/2008 | Pedler et al. | 211/59.2 |
| 2008/0237160 | A1 | 10/2008 | Pedler | |
| 2009/0014352 | A1 | 1/2009 | Foden | |
| 2009/0050589 | A1 | 2/2009 | Pedler | |
| 2009/0272658 | A1 * | 11/2009 | Elias et al. | 206/45.23 |
| 2009/0314661 | A1 * | 12/2009 | Fisher et al. | 206/45.21 |
| 2011/0042548 | A1 * | 2/2011 | Huang | 248/685 |

FOREIGN PATENT DOCUMENTS

| | | |
|---|---|---|
| DE | 90054105 | 7/1990 |
| DE | 3940872 | 6/1991 |
| DE | 91058902 | 8/1991 |
| DE | 92105653 | 12/1992 |
| DE | 10212594 | 10/2003 |
| EP | 0456896 | 11/1991 |
| FR | 2383838 | 10/1978 |
| GB | 617575 | 9/1947 |
| GB | 1068191 | 5/1965 |
| GB | 2088334 | 6/1982 |
| GB | 2146310 | 4/1985 |
| GB | 2188032 | 9/1987 |
| JP | 8113231 | 5/1996 |
| JP | 2003204852 | 7/2003 |
| WO | WO-2005120297 | 12/2005 |
| WO | WO-2006072036 | 7/2006 |
| WO | WO-2006120468 | 11/2006 |

OTHER PUBLICATIONS

"Innovative Designs for Tray, Bliss and Case Packaging, SWF Companies", http://www.swfcompanies.com Nov. 11, 2008 , 3 pages.

"Oral B Assembly Instructions", 48 Count PDQ, Alliance, A Rock-Tenn Company, Concept to Consumer™ undated , 04 pages.

"Wyeth Assembly Instructions", Jun. 2, 2003 , 3 pages.

P.O.P. Design, "PDQ Design Reduces Waste", Jan./Feb. 2007 , 14(1), 02 pages.

Wyeth, "Schematic Drawing for Horizontal Divider (one page)", May 27, 2003.

Wyeth, "Schematic Drawing for PDQ Tray (one page)", Aug. 6, 2003.

Wyeth, "Schematic Drawing for PDQ Tray (one page)", Aug. 12, 2003.

Wyeth, "Schematic Drawing for Product Filler (one page)", Jul. 29, 2003.

Wyeth, "Schematic Drawing for Product Retainer (one page)", May 27, 2003.

Wyeth, "Schematic Drawing for Shipper (one page)", May 28, 2003.

Wyeth, "Schematic Drawing for Top Product Retainer (one page)", May 27, 2003.

Wyeth, "Schematic Drawing for Vertical Dividers (one page)", May 27, 2003.

* cited by examiner

EXPANDABLE DISPLAY SYSTEM

CROSS-REFERENCE TO RELATED APPLICATIONS

This application claims the benefit of U.S. Provisional Application No. 61/173,829 filed Apr. 29, 2009 entitled "Click Tray Display System," the contents of which are incorporated herein by this reference.

FIELD OF THE INVENTION

Embodiments of the invention relate to expandable display systems having a product display portion and an easel support portion.

BACKGROUND

Retail product sales are driven by many factors. Product demand, quality, and pricing are some factors that contribute to retail product sales. Other factors may include product advertising and product location in the retail environment. Many product display devices are designed to take advantage of valuable retail space. Display devices may also be designed to utilize advertising space creatively to include product graphics, indicia, and trademarks.

Because of space limitations, retail establishments place emphasis on the size of display devices while being shipped, stored, and viewed in retail stores. Some retail establishments even require that displays meet particular size specifications to maximize the advertising and display space for the products they contain. Some current display devices often exceed size specification for the products they hold, thereby resulting in wasted space. In addition to space requirements, retail establishments value aesthetic qualities and ease of setup. Display devices and associated products ideally should be easy to setup, requiring minimal time and effort from retail employees. Some current display devices contain lids that must be flipped up and under the product trays to display the products at inclined angles. This design leads to time-consuming efforts on behalf of retail employees to set up the product display. It is thus desirable for display devices to maximize each of the criteria above. In other words, there is demand for display devices that are designed to meet size requirements in various settings, such as shipping, storage, and actual use, while being easy to set up and aesthetically appealing to consumers. It is also desirable to provide efficient delivery of products to the end-consumer by displaying the product at an inclined angle for product visibility, gravity dispensing, and convenience.

BRIEF SUMMARY OF THE INVENTION

Embodiments of this invention include an expandable display system having a product tray with an inner and an outer front flap and an associated easel support. According to one embodiment of this invention, the associated easel support is connected to the product tray, allowing the easel support to collapse against the bottom of the product tray to reduce the height of the expandable display system during shipping. For retail display, the easel support expands and locks in place to display the product at an inclined angle. In this manner, the expandable display system has a collapsed position for shipping and an expanded (inclined) position for retail display.

DETAILED DESCRIPTION

Figure 1:
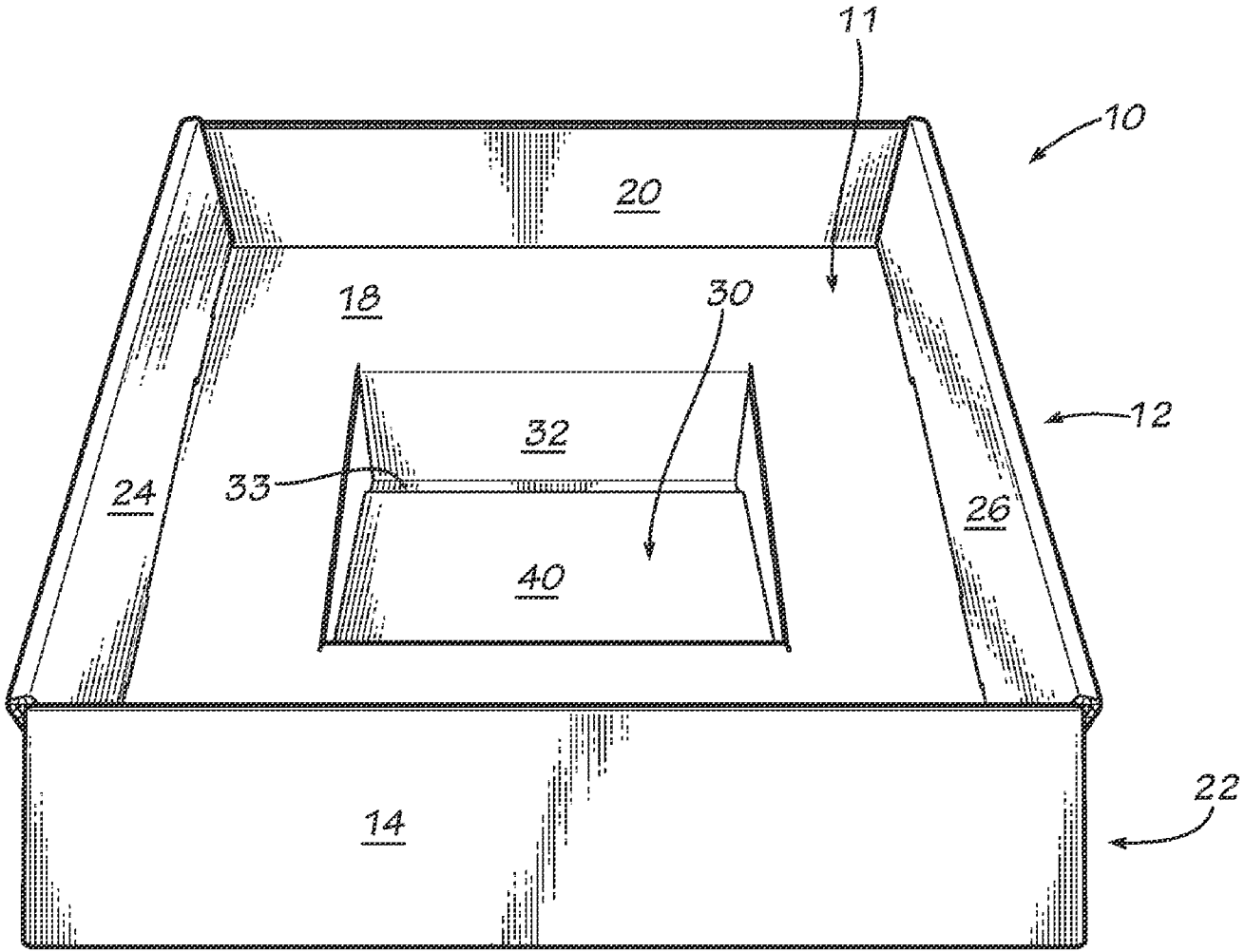
FIG. 1 is a front perspective view of the expandable display system according to one embodiment of the invention, shown in the expanded position.

Embodiments of the invention will be described more fully with reference to the drawings.

FIGS. 1-13 show various views of different embodiments of an expandable display system according to the present invention. FIGS. 1-7 illustrate a first embodiment of the expandable display system 10. As shown in FIGS. 1-7, expandable display system 10 includes a product tray 12 that comprises a bottom panel 18, a rear panel 20, a front panel 22, and side panels 24 and 26. Front panel 22 comprises an outer front flap 14, which may include advertising and graphics to promote the retail product housed within the product tray 12. Front panel 22 also includes an inner front flap 13 and a connecting portion 15 that is adjacent to the outer front flap 14 and that is configured to extend under the bottom panel 18 (FIGS. 4-5).

Figure 2:
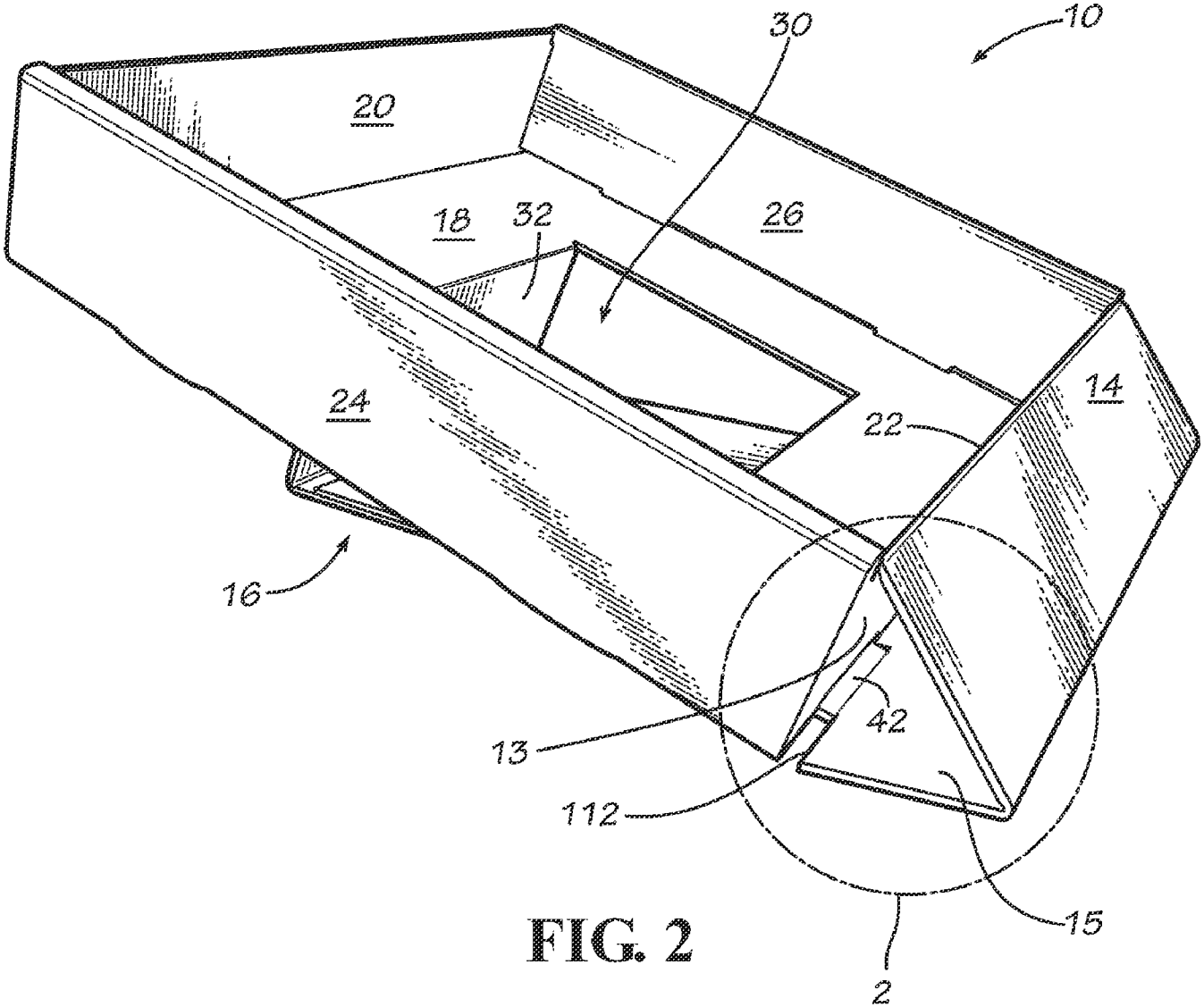
FIG. 2 is a side perspective view of the expandable display system of FIG. 1, shown in the expanded position.

Expandable display system 10 also includes an easel support 16, illustrated in FIGS. 2 and 4. In some embodiments, as shown in FIG. 4, easel support 16 comprises connecting portion 15 of front panel 22, an extension support 32, and an extender 40. In some embodiments, extender 40 is a separate piece (shown in FIGS. 4 and 7) that connects connecting portion 15 of front panel 22 with extension support 32. In certain embodiments, extender 40 is adhered to connecting portion 15 of front panel 22 and extension support 32. Any suitable type of adhesive, including but not limited to white glue, hot melt glue, moisture resistant adhesive, or water resistant adhesive, may be used to secure the extender 40 to a portion of the connecting portion of front panel 22 and a portion of the extension support 32. In some embodiments, fasteners or similar attachment devices may be used to secure extender 40 to connecting portion 15 of front panel 22 and extension support 32.

As set forth in detail below, expandable display system 10 includes a collapsed position (FIG. 5) and an expanded position (FIG. 4). When expandable display system 10 is in the collapsed position, as shown in FIG. 5, easel support 16 collapses against the bottom panel 18 of product tray 12. When in the collapsed position, outer front flap 14 also collapses flat against the inner front flap 13 (FIG. 5). This allows the expandable display system 10 to ship in a smaller, compressed configuration, reducing shipping and storage costs. Because the inclined expandable display systems have a collapsed position and an expanded position, material costs are also reduced. The inclined expandable display systems also achieve cost savings in assembly and setup costs because they can be easily expanded from their collapsed position to their expanded position, thereby reducing the amount of time required for employees to set them up.

Figure 3:
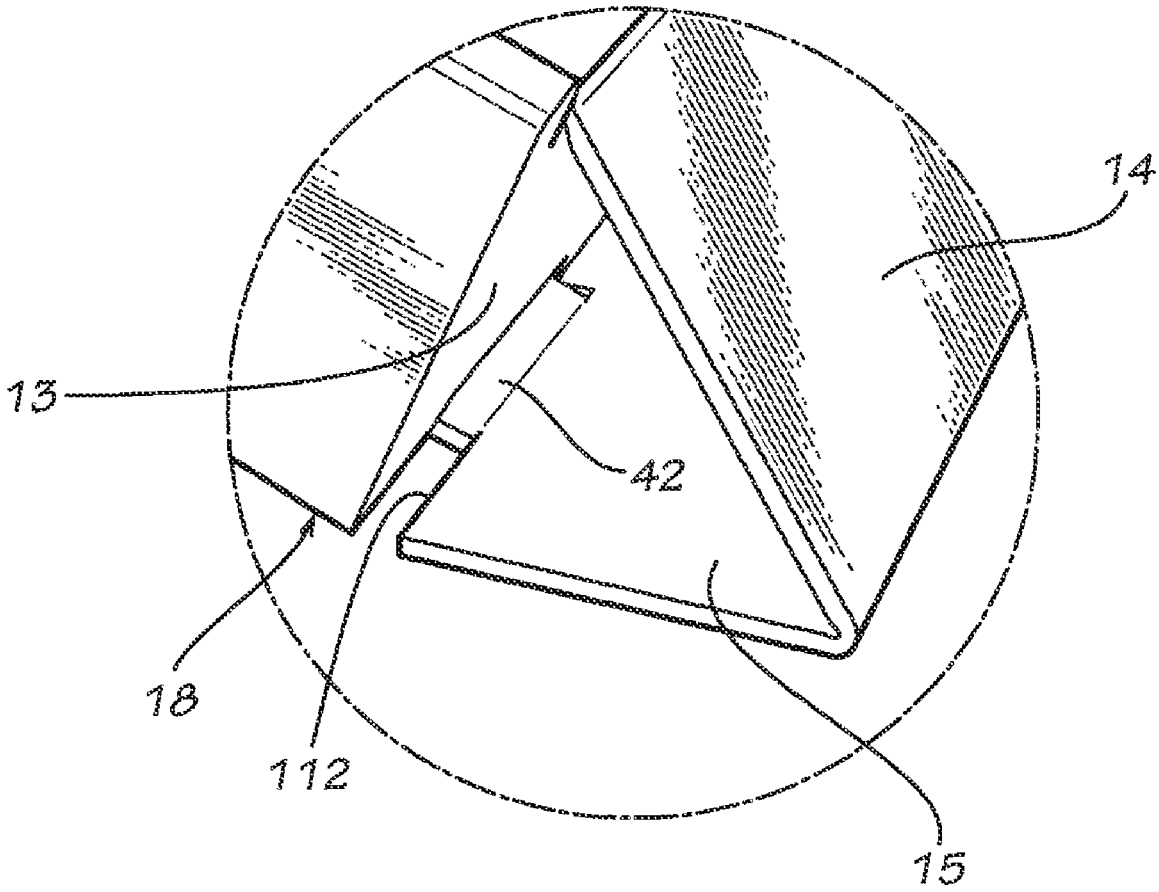
FIG. 3 is an enlarged view taken at inset circle 2 of FIG. 2.
Figure 4:
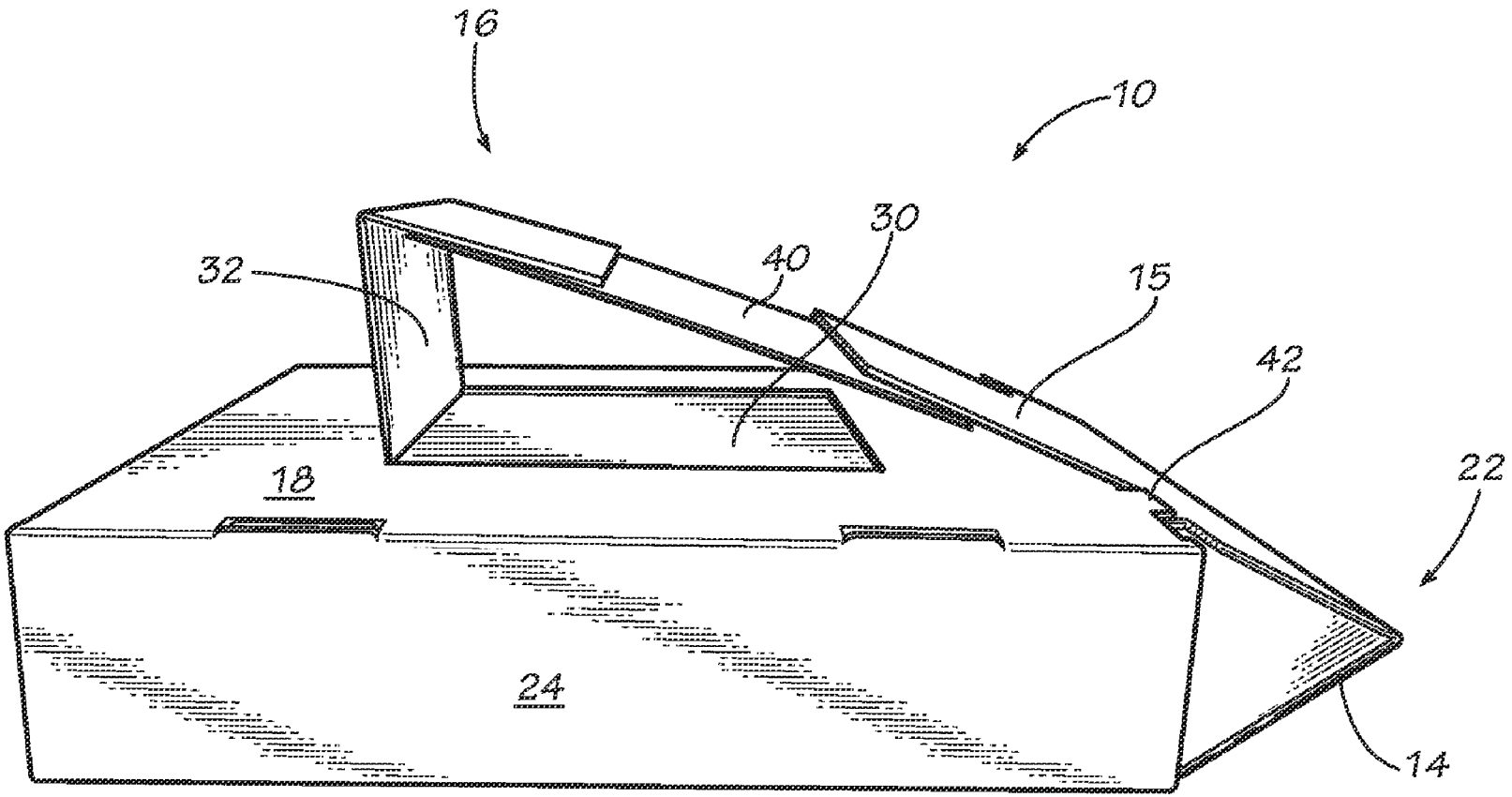
FIG. 4 is bottom side perspective view of the expandable display system of FIG. 1, shown in the expanded position.
Figure 5:
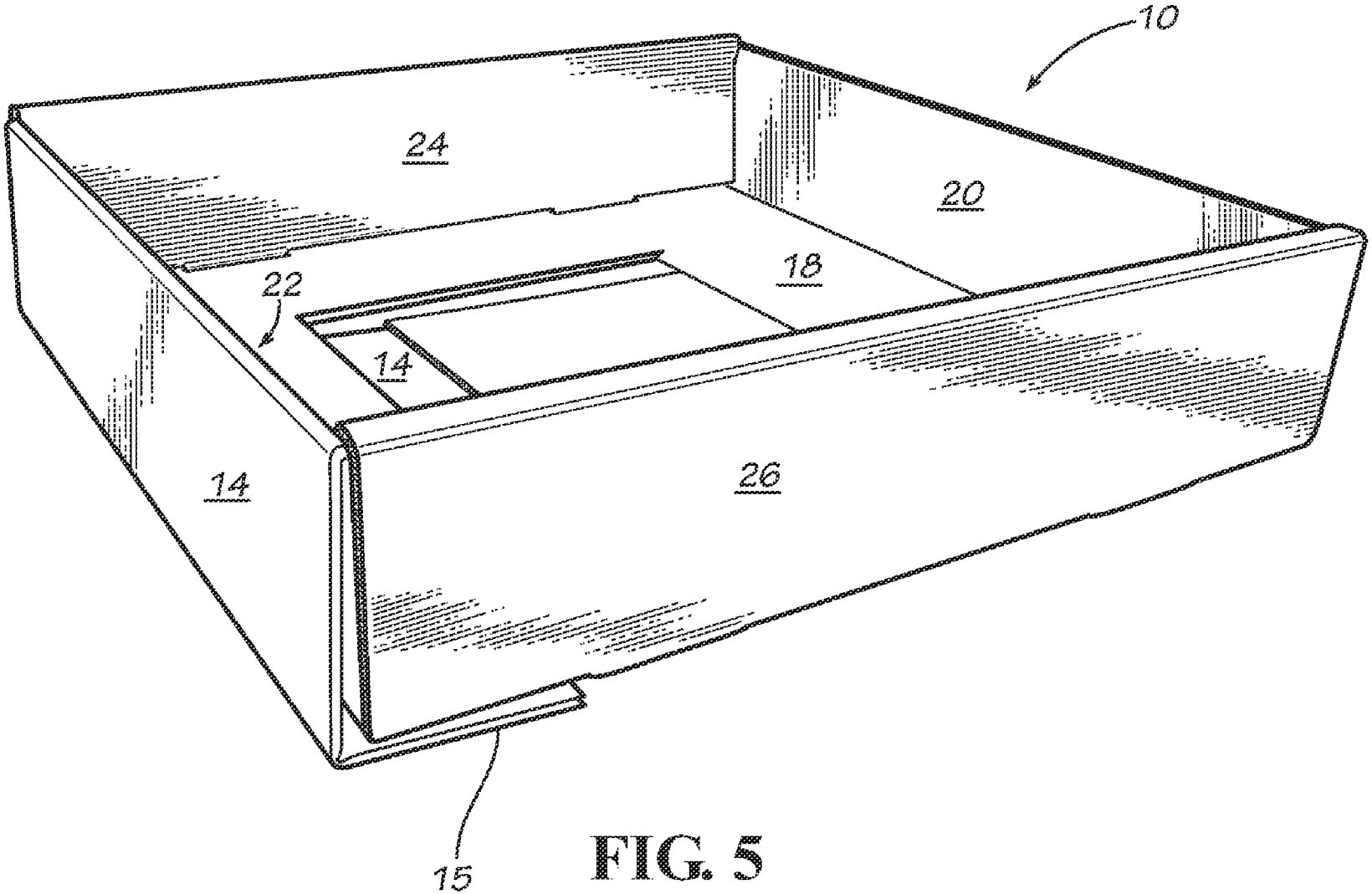
FIG. 5 is a side perspective view of the expandable display system of FIG. 1, shown in the collapsed position.

When the display system 10 is in the expanded position, as shown in FIGS. 2-4, easel support 16 expands to support product tray 12 at an inclined angle relative to a surface on which the easel support 16 rests to provide increased product visibility, dispensing, and convenience. When easel support 16 is expanded so that expandable display system 10 is in the expanded position, outer front flap 14 is also positioned at an angle, as shown in FIG. 2. When the display system is in the expanded position, promotional graphics contained on the outer front flap 14 are more visible and the products housed within the product tray 12 are more easily accessed because the easel support displays the products at an inclined angle created when locking mechanism is engaged so that the edges of connecting portion 15 cooperate with locking tabs (described in detail below).

The blanks illustrated herein are formed from foldable substrates, which may be paper-based material such as paperboard or corrugated sheet material, although other materials may be used if desired. The blanks may be formed from virgin or recycled material, may be coated or uncoated, and may be single-ply or laminated paperboard or other material. Unless otherwise stated, within the borders of an illustration of a blank, broken or dotted lines indicate fold lines, score lines or other lines of weakness, while solid lines indicate cuts or apertures.

Figure 6:
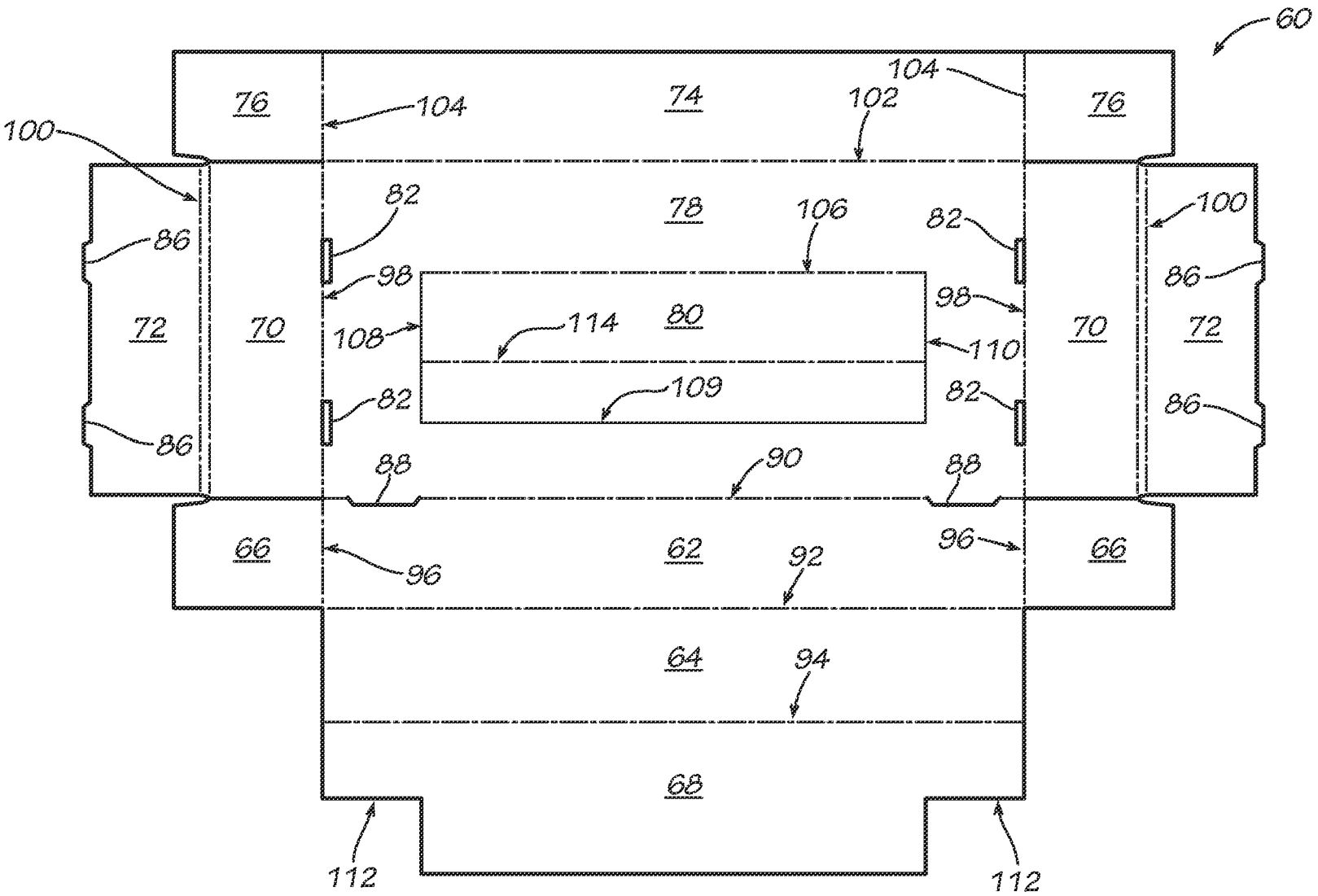
FIG. 6 is a top plan view of the blank from which the expandable display system of FIG. 1 is formed.
Figure 7:
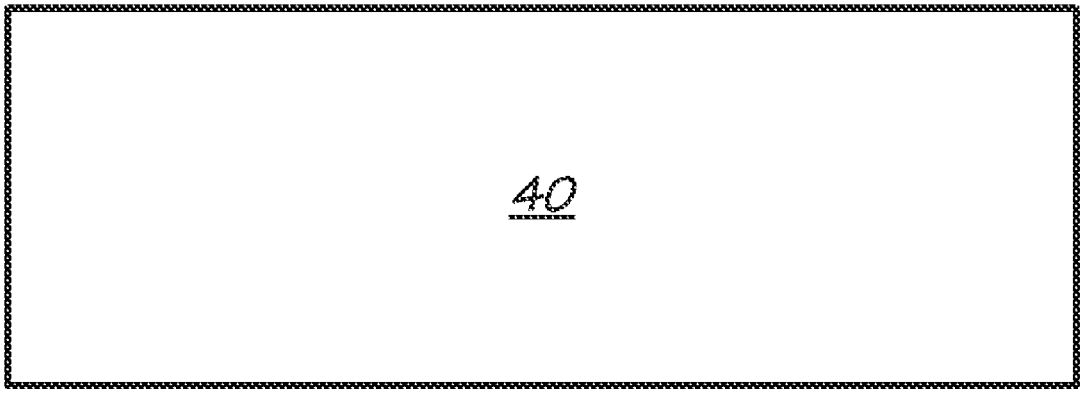
FIG. 7 is a top plan view of the extender used to form a portion of the easel support of the expandable display system of FIG. 1.
Figure 8:
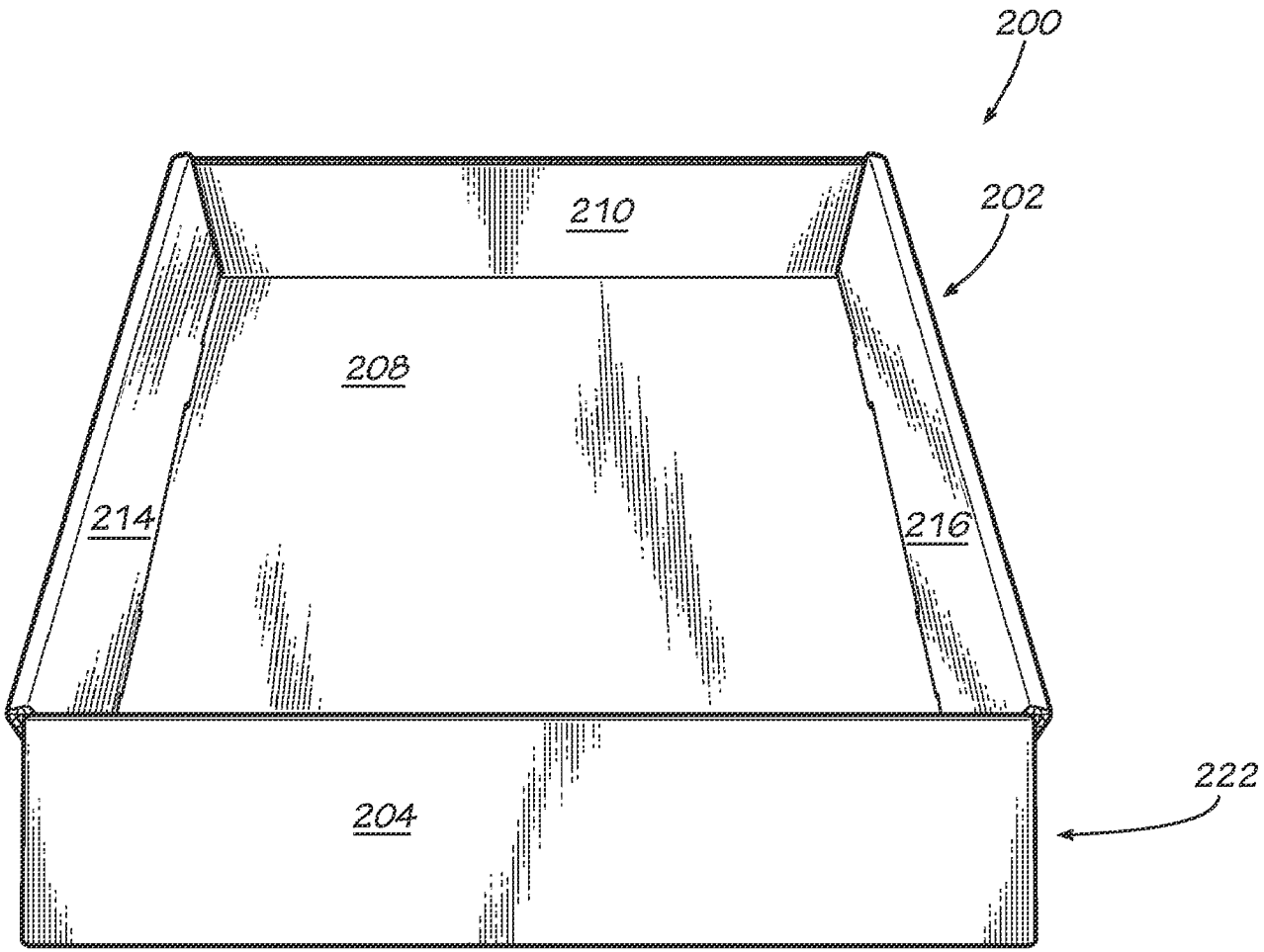
FIG. 8 is a top perspective view of the expandable display system according to another embodiment of the invention, shown in the expanded position.
Figure 9:
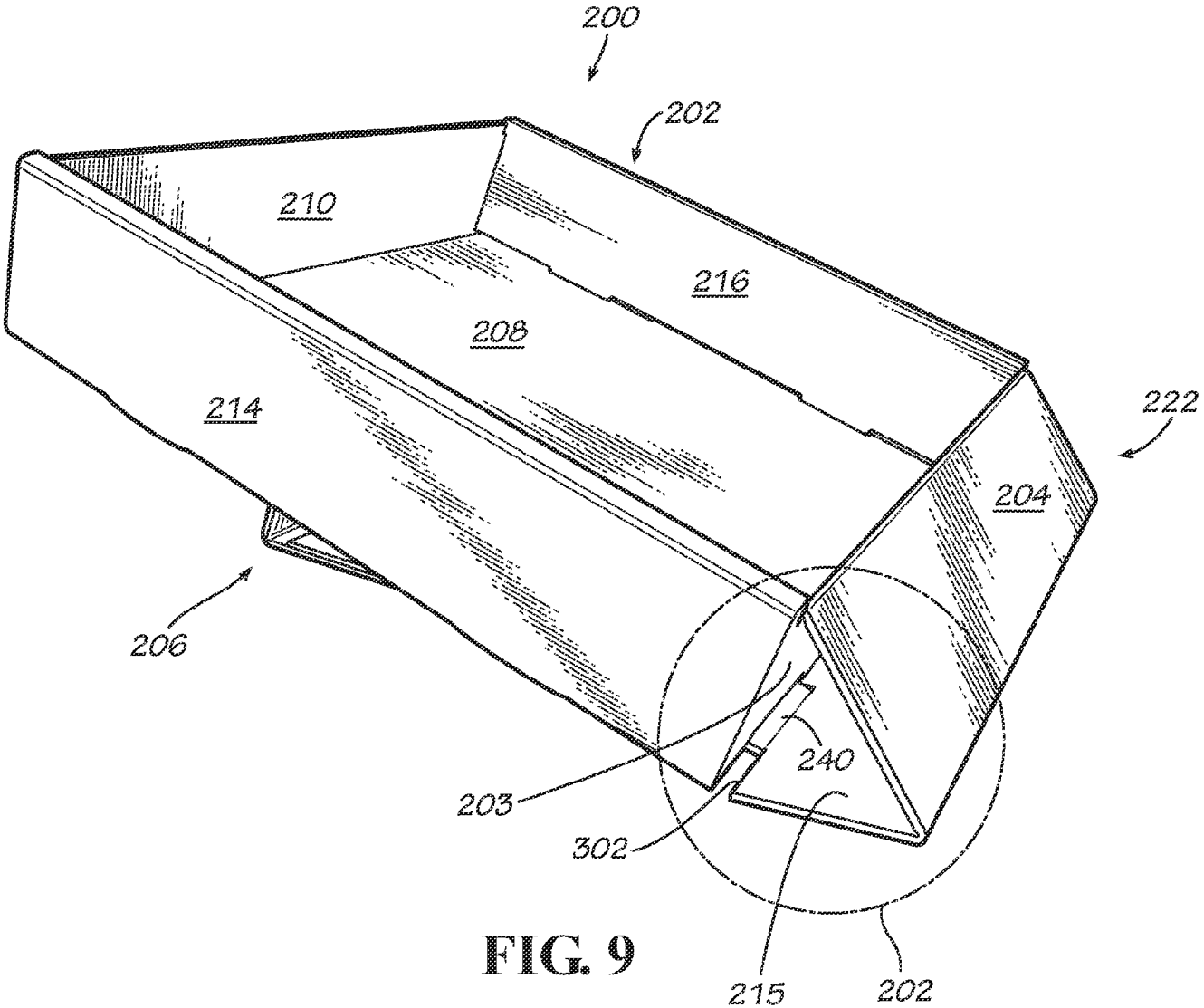
FIG. 9 is a side perspective view of the expandable display system of FIG. 8, shown in the expanded position.
Figure 10:
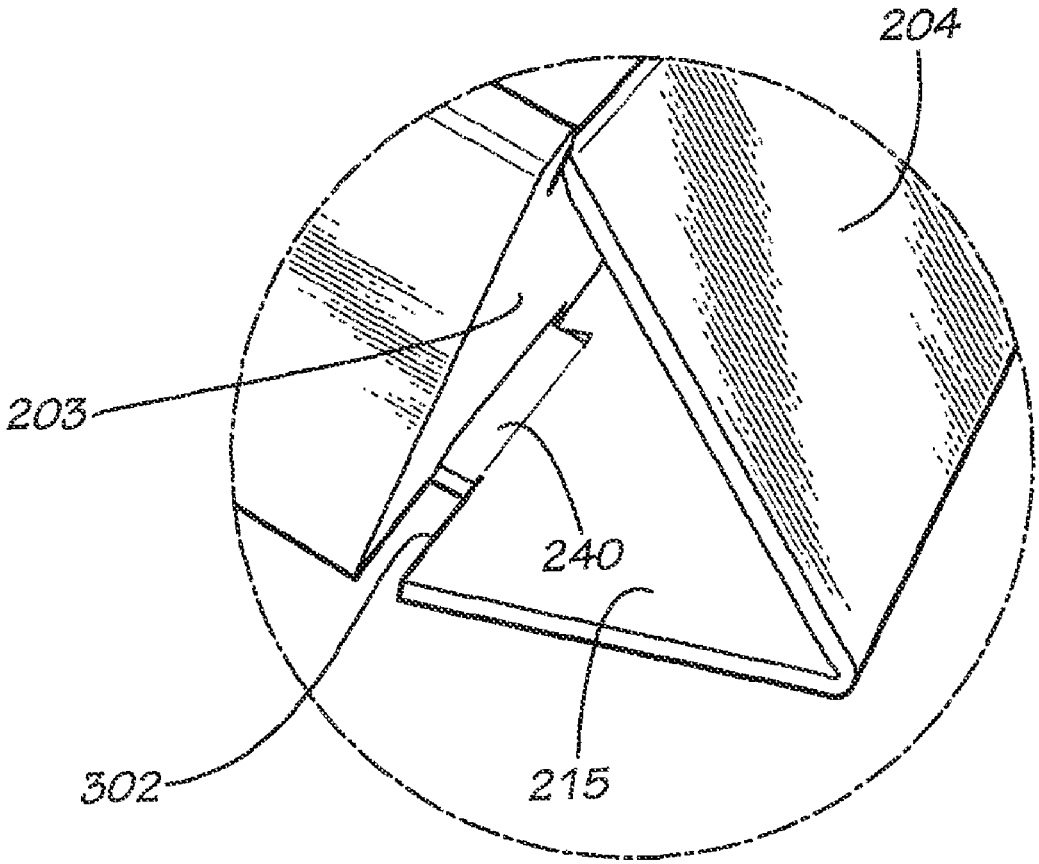
FIG. 10 is an enlarged view taken at inset circle 202 of FIG. 9.

Assembled expandable display system 10 may be formed from blank 60 shown in FIG. 6. Blank 60 includes an inner front panel 62, an outer front panel 64, optional front flaps 66, and a bottom front panel 68, which together form front panel 22 of the formed display. Specifically, the inner front panel 62 corresponds to the inner front flap 13 of the formed display, while the outer front panel 64 corresponds to outer front flap 14 of front panel 22 of the formed display and the bottom front panel 68 corresponds to connecting portion 15 of the front panel 22 of the formed display.

Blank 60 also includes outer side panels 70 and inner side panels 72, which, together with flaps 76 and 66, form side panels 24 and 26 of the formed display. Blank 60 further includes rear panel 74 that corresponds to rear panel 20 of the formed display, bottom panel 78 that corresponds to bottom panel 18 of the formed display, and a partially cut-out bottom panel section 80 that corresponds to extension support 32 of the formed display. Blank 60 further includes bottom panel tabs 88 (which correspond to locking tabs 42 of the formed display) that cooperate with front edges 112 of the bottom front panel 68, as illustrated in FIGS. 2 and 3 and further described below.

Front panel 22 (along with associated outer front flap 14, inner front panel 13 and connecting portion 15) of the assembled product tray 12 is formed by folding inner front panel 62 along fold line 90, folding the outer front panel 64 along fold line 92, and folding the bottom front panel 68 along fold line 94 toward the underside of bottom panel 78.

Upon folding the inner front panel 62 along fold line 90, tabs 88 (which are adjacent to cut lines) protrude from bottom panel 78. As illustrated in FIG. 6, bottom front panel 68 is shaped and configured such that bottom front panel 68 includes edges 112. When bottom front panel 68 is folded along fold lines 94, edges 112 of the bottom front panel 68 may be aligned with bottom panel tabs 88. Specifically, when converting formed display 10 from the collapsed position to the expanded position, edges 112 are capable of locking by way of the locking tabs formed by bottom panel tabs 88, as described below. This provides a locking mechanism for locking the easel support 16 of the formed display in place when the display is converted from the collapsed position to the expanded position.

Rear panel 20 of the assembled product tray 12 may be formed by folding back panel 74 along fold line 102. Side panels 24 and 26 of the assembled product tray 12 may be formed by folding flaps 66 along fold line 96 toward the inside cavity of product tray 12 and folding flaps 76 along fold line 104 toward the inside cavity of product tray 12. Outer side panels 70 are then folded along fold lines 98 toward the inside cavity of product tray 12 and the inner side panels 72 are folded along double fold lines 100 over the front flaps 66 and back flaps 76. Inner side panel tabs 86 are then inserted into the apertures 82. Flaps 66 and flaps 76 are thus located between the inner side panels 72 and outer side panels 70, providing additional structural support for the formed side panels 24 of the product tray 12. In some embodiments, a single fold line may be used instead of double fold lines 100.

The extension support 32 of the formed product tray 12 is formed by separating a portion 80 of the bottom panel 78 along lines 108, 109, and 110. The extension support 32 is then folded along fold line 106 so that it extends toward the underside of bottom panel 78, and is also folded along fold line 114, as shown in FIG. 4.

Easel support 16 may be collapsed or expanded relatively easily with respect to product tray 12 during setup for display. In the expanded positions of FIGS. 2 and 4, easel support 16 expands so that extension support 32 is positioned generally perpendicular to bottom panel 18 instead of in line with bottom panel 18.

As this expansion occurs, front panel 22 shifts forward so that outer front flap 14 is positioned at an angle with respect to inner front flap 13 of product tray 12. When expandable display system 10 is in its expanded position, edges 112 of the connecting portion 15 of front panel 22 abut the inner front flap 13 and are positioned with respect to locking tabs 42 (shown in FIG. 2). As shown in FIGS. 2 and 3, the locking tabs 42 extend from bottom panel 18 of the product tray 12. When the display system is locked in the expanded position, locking tabs 42 are positioned below the edges 112 of connecting portion 15. The abutment of edges 112 with inner front flap 13, in conjunction with the positioning of locking tab 42 relative to edges 112, locks product tray 12 in place at an inclined angle with respect to the surface on which the easel support 16 rests for convenient display of the product to consumers.

As shown in FIGS. 1, 2, and 5, bottom panel 18, front panel 22, rear panel 20, left panel 24, and right panel 26 together form a cavity capable of holding products. In one embodiment, bottom panel 18 also includes an opening 30 formed once extension support 32 is separated from bottom panel 18 by way of perforation lines 108, 109 and 110 (FIG. 6). Once separated, extension support 32 folds along fold lines 106 and 114 (see FIG. 6) into either the collapsed position or the expanded position (shown in FIG. 4).

Because display system 10 includes an opening 30, in some instances it may desirable to position a separate piece along bottom panel 18 to cover the opening 30 and provide a generally flat surface on which product may rest. In other instances, it may be desirable to place the product in a separate container, such container being configured fit within the cavity 11 of product tray 12.

Figure 11:
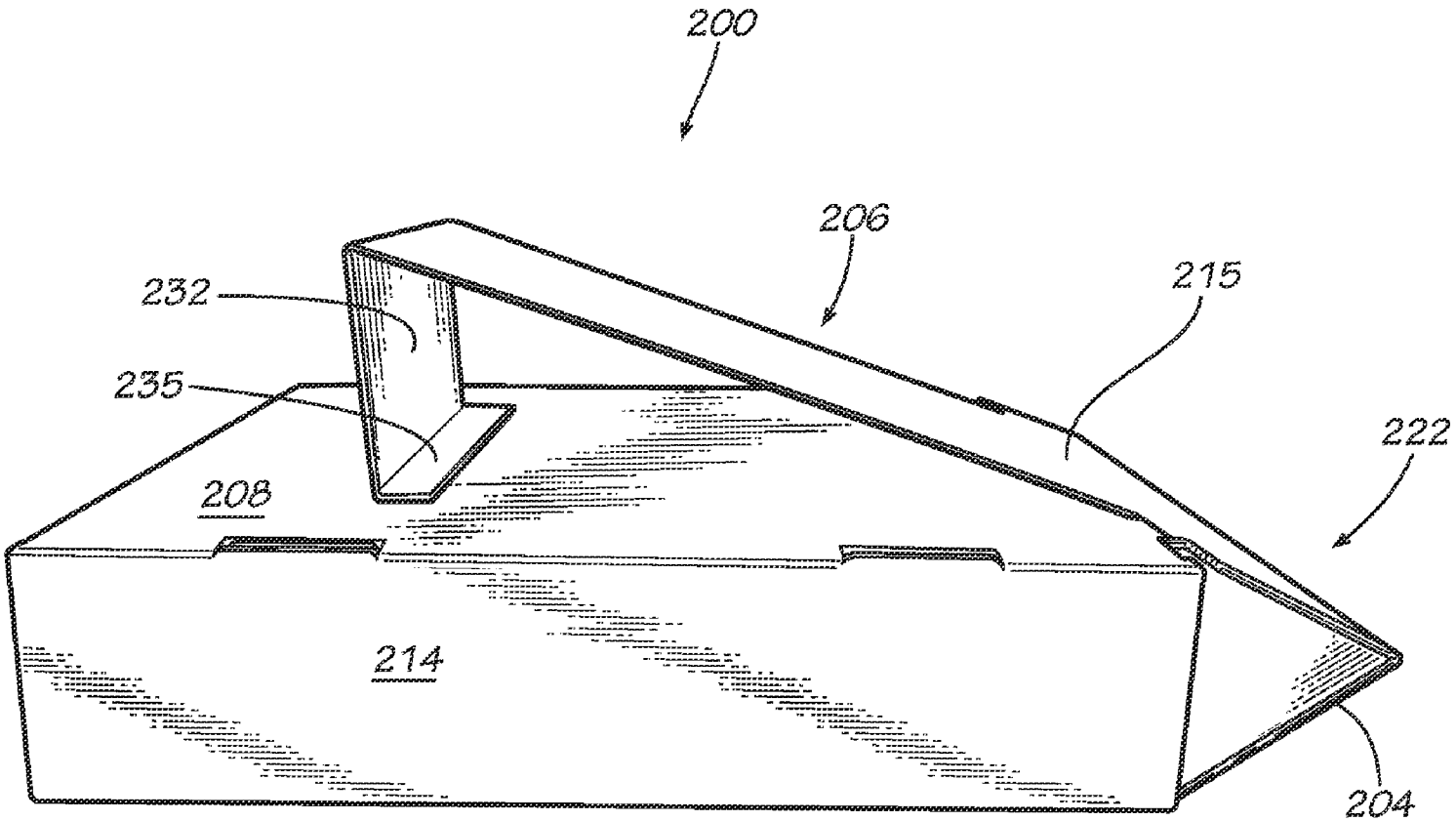
FIG. 11 is bottom side perspective view of the expandable display system of FIG. 8, shown in the expanded position.
Figure 12:
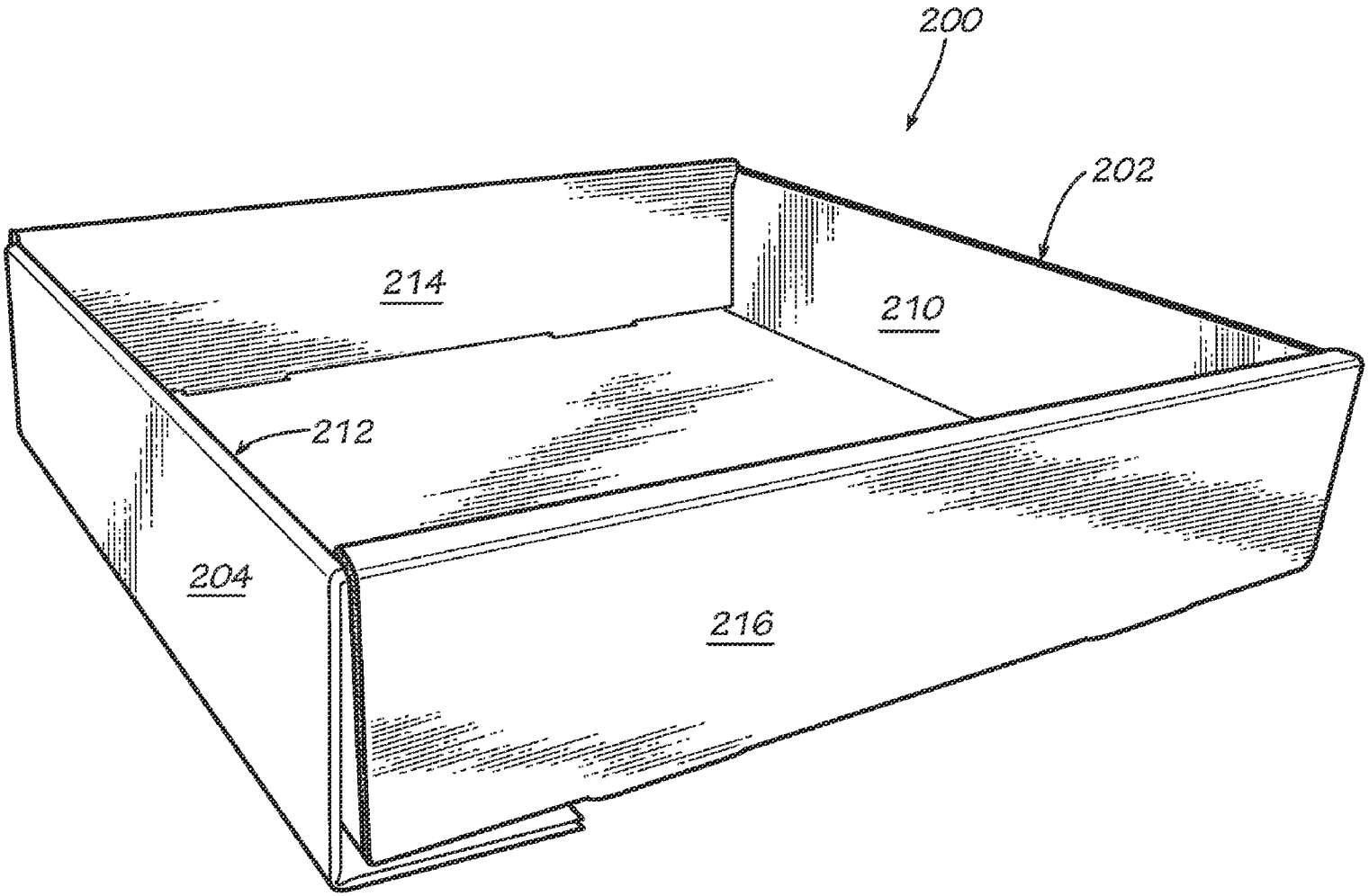
FIG. 12 is a side perspective view of the expandable display system of FIG. 8, shown in the collapsed position.

FIGS. 8-13 illustrate another embodiment of the expandable display system. The expandable display system 200 of FIGS. 8-13 is similar to the expandable display system 10 described above. Instead of having a separate extender 40 (FIG. 7), however, easel support 206 is formed of one integral piece. Specifically, as shown in FIG. 11, front panel 222 (which includes outer front flap 204) is configured to extend underneath bottom panel 208 and attach thereto.

Figure 13:
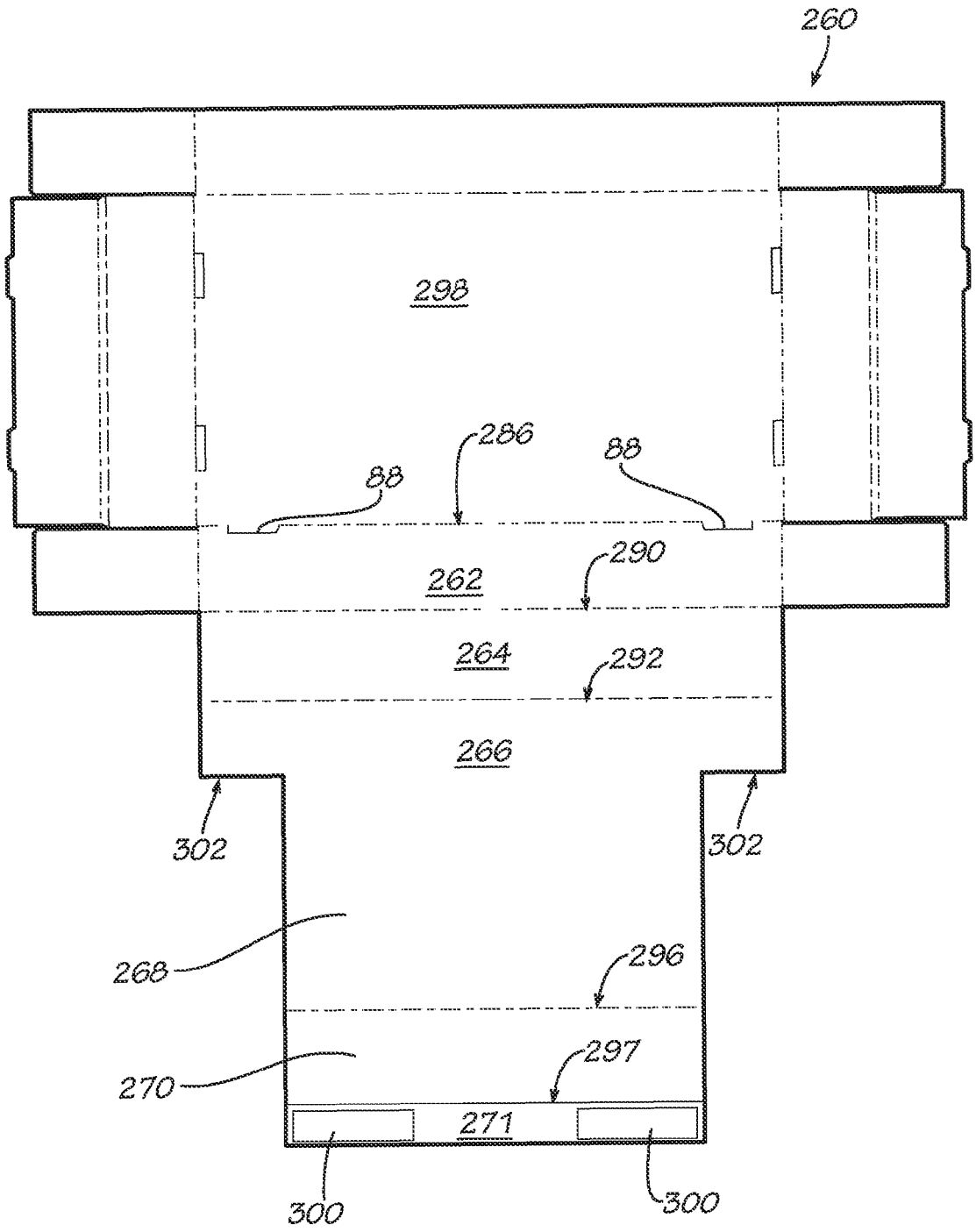
FIG. 13 is a top plan view of the blank from which the expandable display system of FIG. 8 is formed.

FIG. 13 illustrates a blank 260 used to form the assembled display 200. To form assembled display 200, the inner front panel 262 (which corresponds to inner front flap 203 of the formed display) may be folded along fold line 286, the outer front panel 264 (which corresponds to outer front flap 204 of the formed display) may be folded along fold line 290, and the bottom front panel 266 (which corresponds to connecting portion 215 of the formed display) may be folded along fold line 292 toward the underside of the bottom panel 298. The bottom front panel folds along fold line 296 to form a proximate portion 268 and a distal portion 270 (which corresponds to extension support 232 of the formed display). Distal portion 270 may then be folded along fold line 297 to form an attachment portion 271 (which corresponds to glue panel 235 of the formed display). Attachment portion 271 may include one or more glue areas 300 that can be used to adhere attachment portion 271 to bottom panel 298. In this way, expandable display system 200 is formed from a single piece of material.

Locking tabs 240 interact with edges 302 of connecting portion 215 to form a locking mechanism for locking the formed display into the expanded position, and function in the same manner as locking tabs 42 described above.

One-piece expandable display system 200 provides a continuous bottom panel 208 (FIG. 9) that allows product to be displayed directly on bottom panel 208, eliminating the need for an additional substrate or container to cover any openings, such as opening 30 of display system 10, formed in bottom panel.

The design and shape of the one-piece expandable display system 10 and expandable display system 200 (hereafter referred to collectively as the "inclined expandable display systems") may vary depending on the needs of the retail establishment. For example, the product trays of the inclined expandable display systems may be rectangular or square in shape, or may have a curved cutout portion or a scalloped design, and the associated easel supports may be similar in design. The inclined expandable display systems may be any suitable shape and size that meets the requirements of the retail establishment. The bottom panels, side panels, back panels, and front panels as described above may optionally include graphics, trademarks, and other promotional materials to advertise the retail product stored in the product trays.

Also disclosed is a method of converting the display systems from their collapsed position to their expanded position. In some embodiments, the inclined expandable display systems can be prepackaged so that the products are contained within the product tray. Once the expandable display system reaches the retail environment, in one embodiment, a user may grasp the front panel of the product tray and pull it in a generally outward and upward direction until the edges of the connecting portion of the front panel click into place with respect to the locking mechanism. This results in the product tray being inclined at an angled position (as shown in FIG. 2 for expandable display system 10 and FIG. 9 of one-piece expandable display system 200).

Modifications may be made to the structures and methods recited above and shown in the drawings without departing from the scope or spirit of the invention and the following claims.

The invention claimed is:

1. A display system, comprising:

(a) a product tray for housing product, wherein the product tray comprises:

(i) a front panel comprising an inner front flap, an outer front flap, and a connecting portion; and (ii) an extension support extending from a bottom panel of the product tray; and (b) an easel support connected to the product tray, the easel support having a first collapsed position and a second expanded position, the easel support comprising at least a portion of the connecting portion of the front panel and at least a portion of the extension support; and (c) a locking mechanism comprising at least one tab extending from the bottom panel of the product tray and at least one edge of the connecting portion of the front panel, wherein the locking mechanism locks the easel support in the second expanded position when the at least one edge abuts the inner front flap and is adjacent the at least one tab.

2. The display system of claim 1, wherein the extension support is formed from the bottom panel of the product tray.

3. The display system of claim 1, wherein the extension support is integral with the connecting portion of the front panel and wherein the extension support includes a glue panel, the glue panel being generally perpendicular to the extension support.

4. The display system of claim 3, wherein the extender is made from a separate blank from the blank used to form the product tray.

5. The display system of claim 1, wherein the easel support further comprises an extender having a first and second end, wherein the connecting portion of the front panel is connected to the first end of the extender, and the extension support is connected to the second end of the extender.

6. The display system of claim 1, wherein the display system is formed from a single blank.

7. The display system of claim 1, wherein the easel support is collapsed against the bottom panel when the easel support is in the first collapsed position.

8. The display system of claim 1, wherein the outer front flap covers the inner front flap when the easel support is in the first collapsed position.

9. The display system of claim 1, wherein the outer front flap includes promotional materials.

10. The display system of claim 1, wherein, when the easel support is in the second expanded position, the easel support props up the product tray at an inclined angle relative to a surface on which the easel support rests.

11. The display system of claim 1, wherein, when the easel support is in the second expanded position, the outer front flap is at an inclined angle relative to a surface on which the easel support rests.

12. The display system of claim 1, wherein the bottom panel comprises a cutout portion for forming at least a portion of the easel support.

13. The display system of claim 1, wherein the extender is adhered to at least a portion of the connecting portion of the front panel and at least a portion of the extension support.

14. A blank for forming a display system of claim 1 comprising:

(a) a bottom panel;

(b) side panels;

(c) a rear panel;

(d) an inner front panel, an outer front panel, and a bottom front panel, (e) a plurality of fold lines, wherein a first of the fold lines is positioned between the inner front panel and the bottom panel, wherein a second of the fold lines is positioned between the inner front panel and the outer front panel, and wherein a third of the fold lines is positioned between the inner front panel and the bottom front panel;

(c) at least one locking mechanism located adjacent the bottom panel, wherein the at least one locking mechanism is adjacent to at least one cut line; and wherein the bottom front panel comprises at least one edge configured to cooperate with the at least one locking mechanism.

15. The blank of claim of 14, wherein the bottom panel further comprises a cutout portion positioned adjacent to at least two lines of perforation and configured to form a portion of an easel support.

16. A display system, comprising:

(a) a product tray for housing product, the product tray comprising an inner front flap, an outer front flap, a bottom front flap, and a bottom panel; and (b) an easel support connected to the product tray, wherein at least a portion of the bottom front flap comprises at a least a portion of the easel support and wherein another portion of the easel support is attached to the bottom panel of the product tray;

(c) a locking mechanism comprising at least one tab extending from the bottom panel of the product tray and at least one edge of the bottom front flap, wherein the locking mechanism locks the easel support in a second position when the at least one edge abuts the inner front flap and is adjacent the at least one tab, wherein, when the display system is in a first position, at least a portion of the easel support is collapsed against the bottom panel of the product tray; and wherein, when the display system is in the second position, the easel support is expanded such that the product tray is at an inclined angle relative to a surface on which the easel support rests.

17. The display system of claim 16, wherein the easel support further comprises an extender that connects one portion of the easel support to at least a portion of the bottom front flap and another portion of the easel support to at least a portion of the bottom panel of the product tray.

18. The display system of claim 16, wherein the easel support is integral with the bottom front flap and further comprises a glue panel positioned adjacent to the bottom panel of the product tray.

19. The display system of claim 16, wherein, when the display system is in the second position, the product tray rests at an inclined angle relative to a surface on which the easel support rests to display the product housed in the product tray.

20. A method of converting a display system from a first position to a second position, comprising:

(1) providing a product tray comprising:

(a) a front panel, the front panel comprising an outer front flap, an inner front flap, and a connecting portion, the connecting portion further comprising at least one edge;

(b) an easel support, wherein at least a portion of the easel support is comprised of a portion of the connecting portion of the front panel and wherein the easel support is in the first position so that at least a portion of the easel support is collapsed against the bottom panel of the product tray;

(2) expanding the easel support from the bottom panel of the product tray into the second position so that the easel support supports the product tray at an angle relative to a surface on which the easel support rests; and (3) locking the easel support in the second position by positioning the at least one edge of the connecting portion so that it abuts the inner front flap of the front panel and is adjacent a locking tab that extends from the bottom panel of the product tray.

* * * * *